US005551262A

United States Patent [19]

Seo

[11] Patent Number: 5,551,262

[45] Date of Patent: Sep. 3, 1996

[54] POWER TRANSMISSION APPARATUS OF A WASHING MACHINE

[75] Inventor: Je-Man Seo, Suwon, Rep. of Korea

[73] Assignee: Samsung Electronics Co., Ltd., Suwon, Rep. of Korea

[21] Appl. No.: 394,745

[22] Filed: Feb. 27, 1995

[30] Foreign Application Priority Data

Feb. 28, 1994 [KR] Rep. of Korea ..... 1994-3812

[51] Int. Cl.[6] ..... D06F 37/40

[52] U.S. Cl. ..... 68/23.7; 192/84.3

[58] Field of Search ..... 68/23.6, 23.7; 192/84 PM

[56] References Cited

U.S. PATENT DOCUMENTS

| | | | |
|---|---|---|---|
| 2,109,620 | 3/1938 | Kirby | 68/23.7 |
| 2,609,697 | 9/1952 | Ruscoe | 68/23.7 X |
| 2,648,213 | 8/1953 | Castner | 68/23.7 |
| 2,869,698 | 1/1959 | Conlee | 68/23.7 X |
| 2,886,149 | 5/1959 | Baermann | 192/84 PM X |
| 2,947,159 | 8/1960 | Fernandez | 68/23.7 |
| 3,240,304 | 3/1966 | Wickersham | 192/84 PM X |
| 3,279,223 | 10/1966 | Severance et al. | 68/23.7 X |
| 3,557,580 | 1/1971 | Racenis | 68/23.7 |

*Primary Examiner*—Philip R. Coe

*Attorney, Agent, or Firm*—Burns, Doane, Swecker & Mathis, L.L.P.

[57] ABSTRACT

A clothes washing machine includes a spin-drying tub and an oscillatory pulsator disposed in the tub. A first shaft arrangement transmits a driving force from an electric motor to the pulsator during a wash cycle. A second shaft arrangement, coaxial with the first shaft arrangement, is connected to the tub. An electromagnetic clutch selectively couples and uncouples the second shaft arrangement relative to the first shaft arrangement. The clutch includes a pair of discs connected to the respective shaft arrangements for common rotation therewith. One of the discs is connected by splines to its associated shaft arrangement and is movable axially toward and away from the other disc by a magnetic attraction produced by an electromagnet carried by one of the discs. When brought axially together, the discs transmit drive from the first shaft arrangement to the second shaft arrangement for driving the tub and pulsator together during a spinning cycle.

8 Claims, 9 Drawing Sheets

POWER TRANSMISSION APPARATUS OF A WASHING MACHINE

BACKGROUND OF THE INVENTION

1. Field of the Invention

The present invention relates to a power transmission apparatus of a clothes washing machine adapted to transmit power during washing and spin-drying processes.

2. Description of a Prior Art

Typically, a washing machine is provided with a washing tub 3 in a body 1 as illustrated in FIG. 1.

The washing tub 3 is provided at a bottom surface thereof with power transmission means 13 for receiving a turning effect of a motor 5 through a belt 7 to thereby drive a spin-drying tub 9 or a pulsator 11.

In other words, the washing tub 3 is provided at an interior thereof with a spin-drying tub 9 for spin-drying laundry according to a centrifugal force generated by a driving of the motor in such way as to be rotated on a driving axis of the power transmission means 13.

The pulsator 11 disposed on the driving axis of the power transmission means 13 is provided at an interior of the spin-drying tub 9 in order to oscillate according to the driving of the motor 5 to thereby agitate washing water stored in the spin-drying tub 9 and to carry out the washing.

The body 1 is constructed at an upper side thereof with water supply means 14 for being connected to a faucet 12 to thereby supply the washing water into the washing tub 3, and the washing tub 3 includes at a lower surface thereof drainage means for draining the washing water.

In the conventional washing machine thus constructed, when the laundry is put into the spin-drying tub 9 in the washing tub 3 and a washing condition is selected on a control panel (not shown), the washing water (by way of example, warm water or cold water) is supplied to the spin-drying tub 9 through the water supply means 14 according to an opening operation of the faucet 12, and then the turning effect according to activation of the motor 5 is reduced through the power transmission means 13, to thereby be transmitted for rotation of the pulsator 11.

At this time, the pulsator keeps oscillating, to thereby cause the water in the spin-drying tub 9 to be in turbulence, and at the same time, to carry out the washing by adding a physical force to the laundry.

When the washing process is completed, the washing water is discharged according to activation of drainage means 15, and at the same time, water is supplied again through the water supply means 14. A rinsing process is carried out several times and then the spin-drying tub 9 performs a drying job on the laundry according to the centrifugal force generated by the spin-drying tub 9 rotating at a high speed, to thereby complete the washing.

Meanwhile, a power transmission apparatus, as illustrated in FIG. 2, has a rotatable driving washing shaft 19 fixedly mounted to a pulley 17 for being rotated by a belt 7 according to a driving of the motor 5, and the driving washing shaft 19 is provided at an exterior lower side thereof with a driving coupling 21 and at the same time, a first spin-drying shaft 23 is rotatably supported at an upper side thereof by a bearing 33. The first spin-drying shaft 23 is coupled at an upper side thereof to a connector 25 functioning as a brake drum, thereby rotating integrally with the first spin-drying shaft 23.

The connector 25 is connected at an upper side thereof to a second spin-drying shaft 27, which is thereby rotating integrally with the connector, and the second spin-drying shaft 27 is coupled at an upper side thereof to the spin-drying tub 9, so that the tub 9 can rotate with the connector 25.

The interior of the second spin-drying shaft 27 is provided with a washing shaft 29 mounted at an upper end thereof to the pulsator 11 through the intermediary of a bushing member (not shown).

In the meantime, rotation from the driving washing shaft 19 to the shaft 29 is reduced in speed by a planetary gear (not shown) within the connector 25.

Furthermore, the first spin-drying shaft 23 is supported by the lower bearing 33 inserted into a lower case 31, so that the first spin-drying shaft 23 can easily rotate, and the second spin-drying shaft 27 is supported by an upper bearing 37 inserted into an upper case 35, so that the second spin-drying shaft 27 can easily rotate.

The connector 25 is provided at a periphery thereof with a brake band 39 so that racing of the spin-drying tub 9 can be prevented during the washing process and at the same time, the band can perform a braking function against the spin-drying tub 9 during stoppage of the spin-drying process. The brake band 39 is supportedly connected to a brake lever 41.

A clutch spring 45 supported by a clutch boss 43 is arranged over the first spin-drying shaft 23 and the driving coupling 21, and the clutch boss 43 is connected to a clutch lever 49 by a connecting member 47.

In the power transmission apparatus thus constructed, the brake lever 41 is activated to cause the brake band 39 to be in a wound (braking) state during the washing process, and the clutch lever 49 is activated to cause the clutch spring 45 to be in an unwound (non braking) state.

The driving washing shaft 19 and the first spin-drying shaft 23 are thus in a relatively rotatable state.

The turning effect generated by the motor 5 and transmitted from the driving washing shaft 19 to the washing shaft 29 is reduced in speed by a planetary gear in the connector 25.

The pulsator 11 coupled to an upper side of the longitudinally washing shaft 29 oscillates repeatedly to carry out the washing.

At this time, the spin-drying tub 9 tends to be rotated by the laundry and the water current, however that tendency thereof can be prevented by the brake band 39.

During the spin-drying process, the states of the brake lever 41 and the clutch lever 49 are reversed from that of the washing process, thereby unwinding the brake band 39, and at the same time, winding the clutch spring 45, so that the driving washing shaft 19 and the first spin-drying shaft 23 are locked for common rotation.

Accordingly, the turning effect of the motor 5 is transmitted from the driving washing shaft 19 through the first spin-drying shaft 23, connector 25, and the second spin-drying shaft 27 in that order, so that the spin-drying tub 9 fixed to an upper side of the second spin-drying shaft 27 is rotated to thereby perform the spin-drying.

During the stoppage of the spin-drying process or during an electrical black-out, the brake lever 41 is activated, thereby causing the brake band 39 to be in a unwound state and to cease the rotation of the spin-drying tub 9.

However, according to the conventional power transmission apparatus thus constructed, there is a problem in that the clutch spring used for transmission of the power, requires the provision of a number of components whereby a manufacturing cost thereof has increased and the clutch spring has failed to completely transmit the electric power.

As a prior art another conventional power transmission apparatus in a washing machine, is disclosed in Japanese Utility model publication No. Hei 2-46861.

The power transmission apparatus disclosed in the publication No. Hei 2-46861, as illustrated in FIG. 3, comprises a washing shaft 19' mounted to a pulsator 11' and a spin-drying shaft 23' mounted to a spin-drying tub 9'. During a washing process, only the washing shaft 19' is driven (i.e., oscitted), and during a spin-drying process, the spin-drying shaft 23' along with the washing shaft 19' is rotated by a clutch spring 45'. The power transmission apparatus disclosed in the publication No. Hei 2-46861 is characterized by a one-way clutch for transmitting the power in such way that the spin-drying shaft 23' is rotated in a spin-drying direction only, and is prevented from rotating in a reverse direction.

In the power transmission apparatus thus constructed, the washing is carried out during the washing process by the oscittation of the pulsator 11' only according to the oscittation of a motor (not shown), and during the spin-drying process, the spin-drying is performed by simulataneous rotations of the pulsator 11' and the spin-drying tub 9'.

However, there is another problem in that an overload may occur in the motor 5' because of a construction of the clutch spring 45', whereby a life span of the motor 5' is shortened. Also, due to the clutch spring 45' and numerous components related thereto, difficulty in processing the components, manufacturing costs are increased and a complete transmission of the power cannot be accomplished.

Accordingly, the present invention is intended to solve the aforementioned problems, and it is an object of the present invention to provide a power transmission apparatus of a washing machine employing an electromagnet for transferring an electric power, thereby reducing a manufacturing cost and at the same time, carrying out a complete transmission of the power during washing and spin-drying processes.

SUMMARY OF THE INVENTION

In accordance with the object of the present invention, there is provided a power transmission apparatus of a washing machine by which an electric power is transmitted from a driving washing shaft to a longitudinally moving washing shaft in order to drive a pulsator during the washing process, and the electric motor power is transmitted from the driving washing shaft to a second spin-drying shaft via a first spin-drying shaft in order to drive a spin-drying tub during the spin-drying process, the apparatus comprising:

a spin-drying tub disc for being fixedly coupled to a lower side of a first spin-drying shaft so that the same can be integrally rotated therewith; and a pulsator disc for being slidingly coupled to a driving washing shaft, so that the electric power can be transmitted to or cut off from a spin-drying tub disc.

Furthermore, the first spin-drying shaft is fixedly coupled at a lower side thereof to a spin-drying disc employing a first electromagnet, so that the first spin-drying shaft can be integrally rotated therewith, and a thin metallic pulsator disc is slidingly coupled to a driving washing shaft, so that the electric power can be transmitted to or cut off from the spin-drying tub disc.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS OF THE INVENTION

Embodiments of the present invention will now be described in detail with reference to the accompanying drawings.

Figure 1:
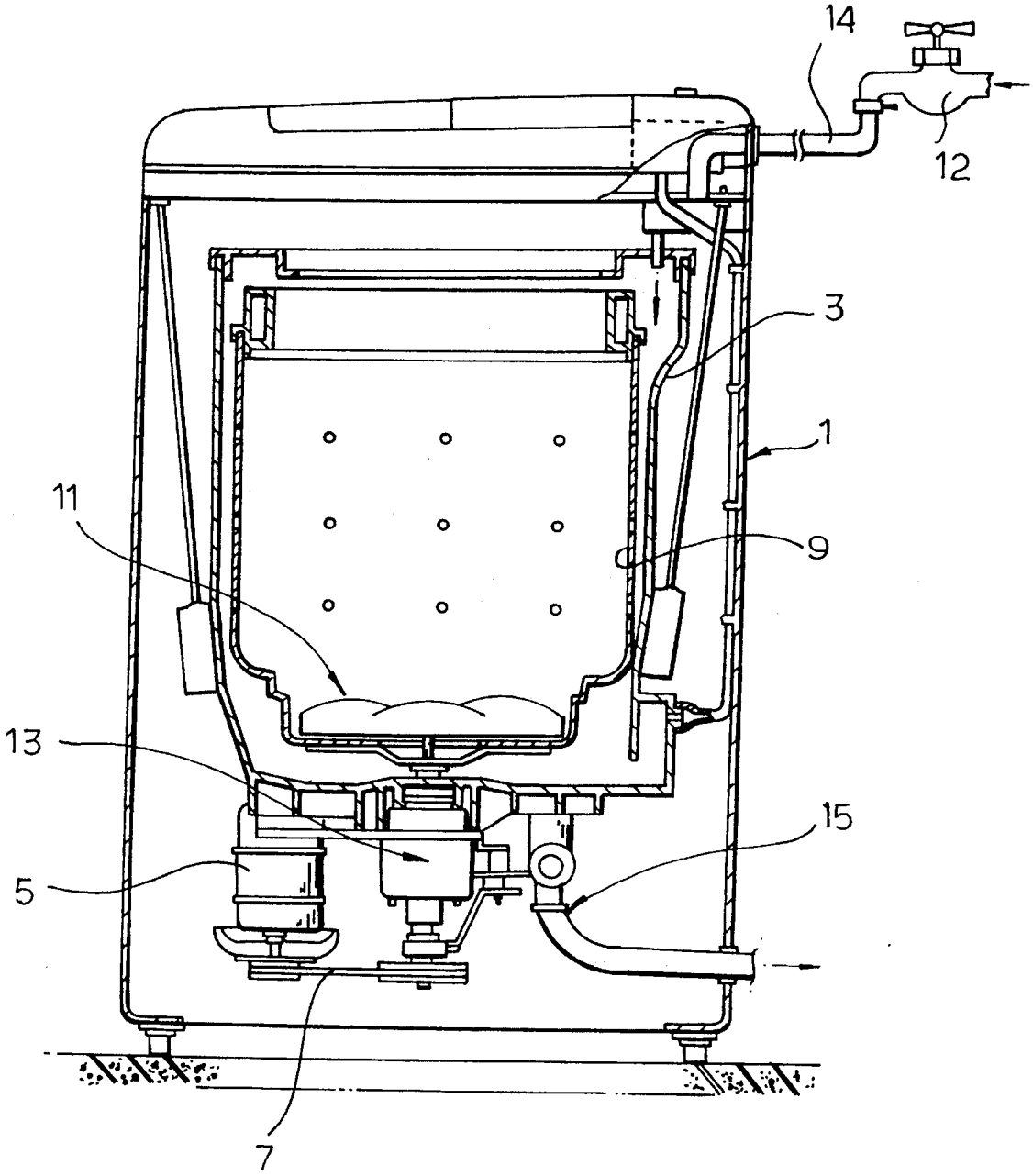
FIG. 1 (Prior Art)
FIG. 1 is an overall longitudinal sectional view for illustrating a conventional washing machine.
Figure 2:
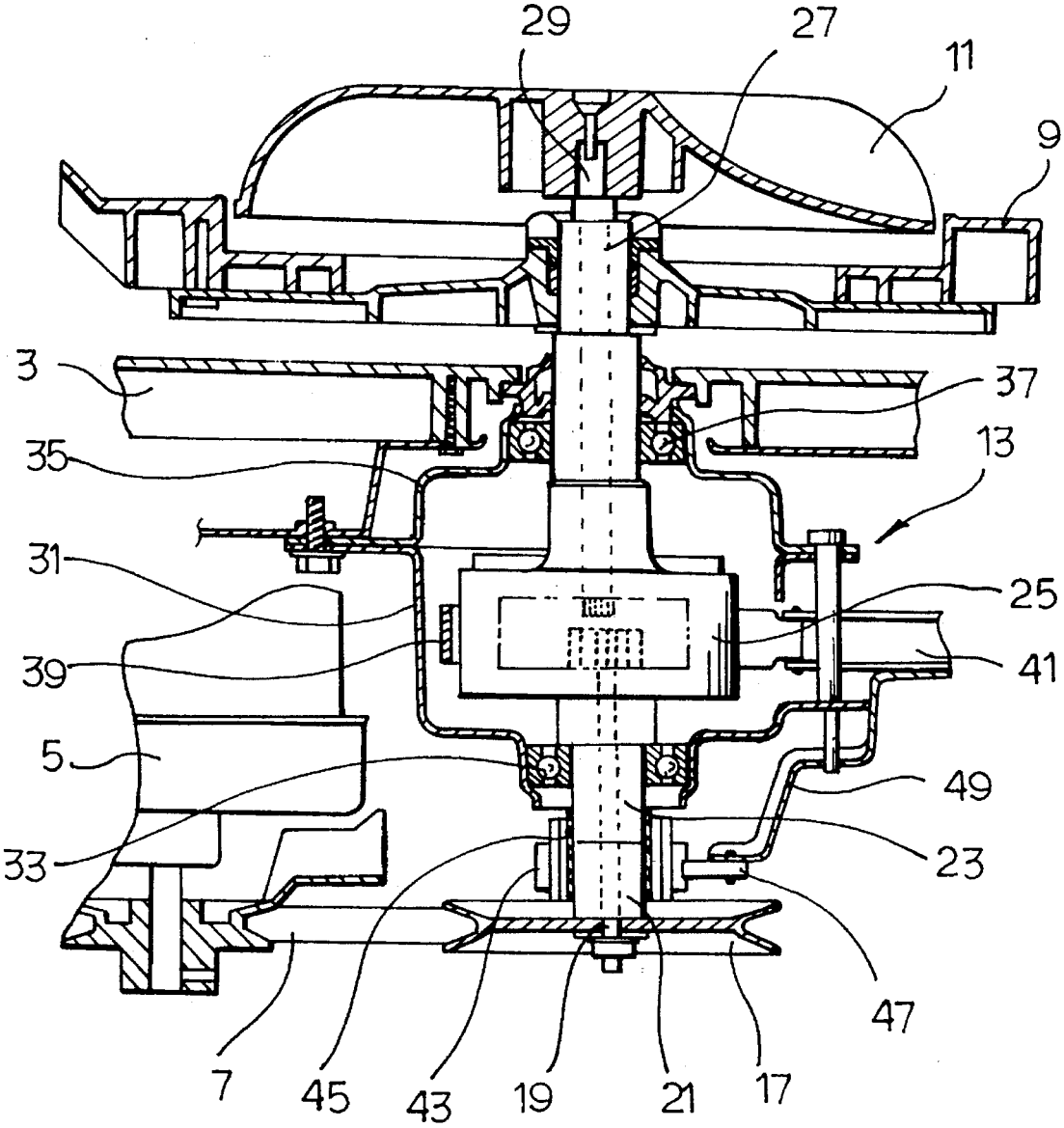
FIG. 2(Prior Art)
FIG. 2 is a longitudinal sectional view illustrating a power transmission apparatus in FIG. 1.
Figure 3:
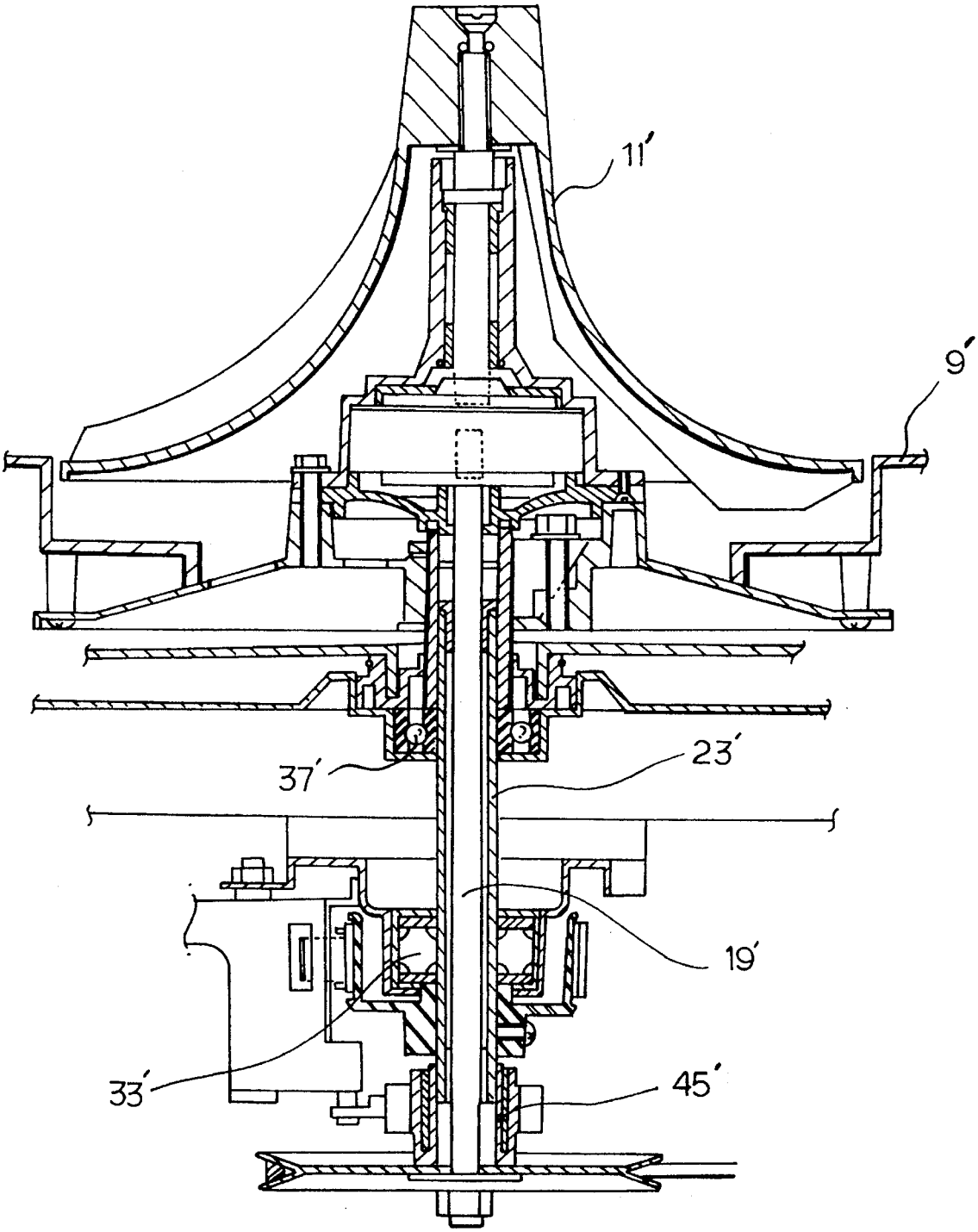
FIG. 3 (Prior Art)
FIG. 3 is a longitudinal sectional view illustrating a power transmission apparatus in another conventional washing machine.

Throught the drawings, like reference numerals to those of FIGS. 1 and 2 are used for designation of like or equivalent parts or portions but redundant descriptions are omitted for simplicity of illustration and explanation.

Figure 4:
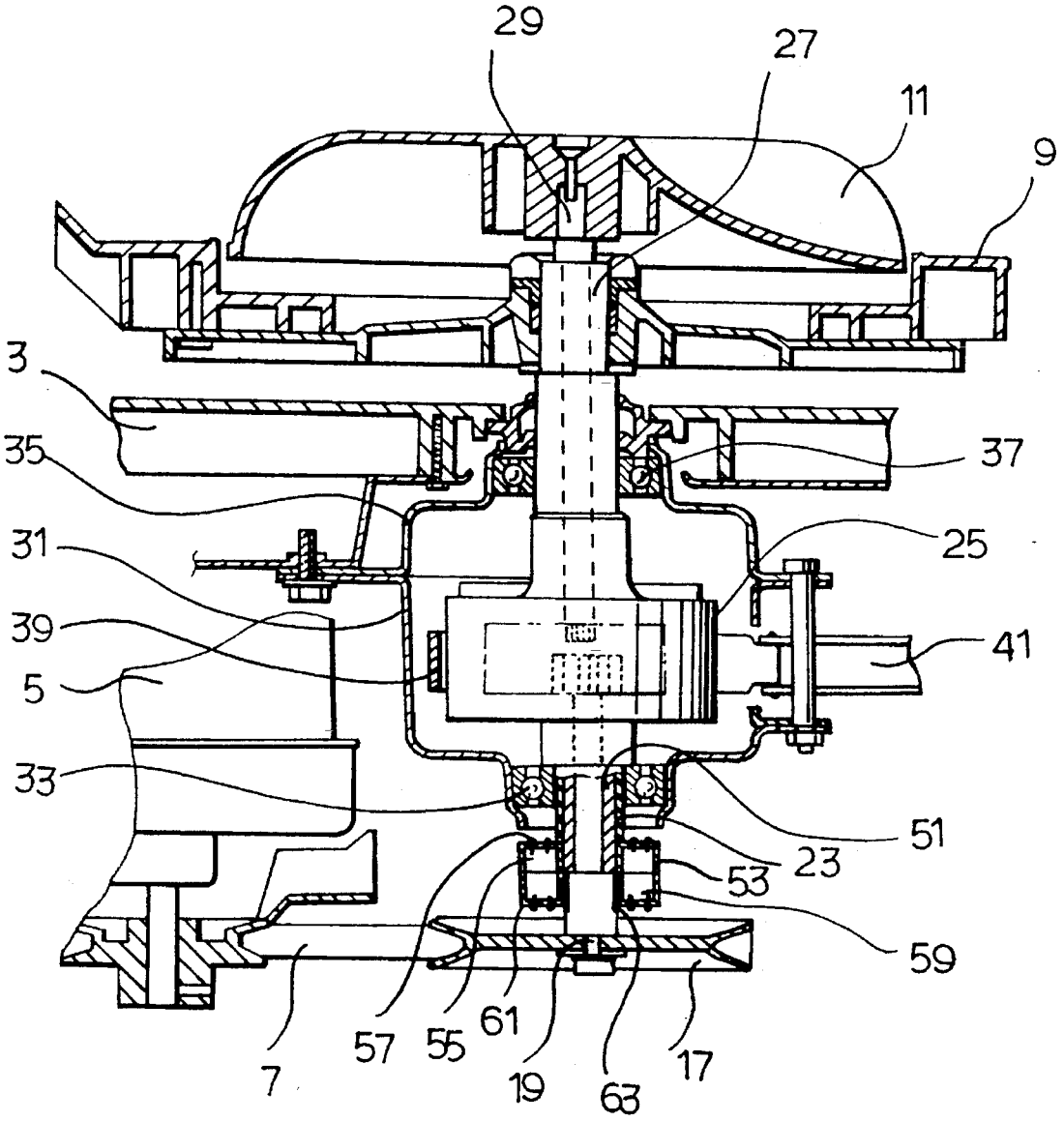
FIG. 4 is a longitudinal sectional view illustrating a power transmission apparatus of a washing machine according to one embodiment of the present invention.

As illustrated in FIG. 4, a first spin-drying shaft 23 is rotatably disposed on an outer side of the driving washing shaft 19 under a lower case 31 by means of a bushing member 51, so that the electric motor power can be transmitted to a second spin-drying shaft 27 through a connector 25.

The first spin-drying shaft 23 is fixedly coupled at a lower side thereof to a spin-drying tub disc 53 by fastening means (not shown) so that the shaft 23 can integrally rotate with the disc 53.

Figure 5:
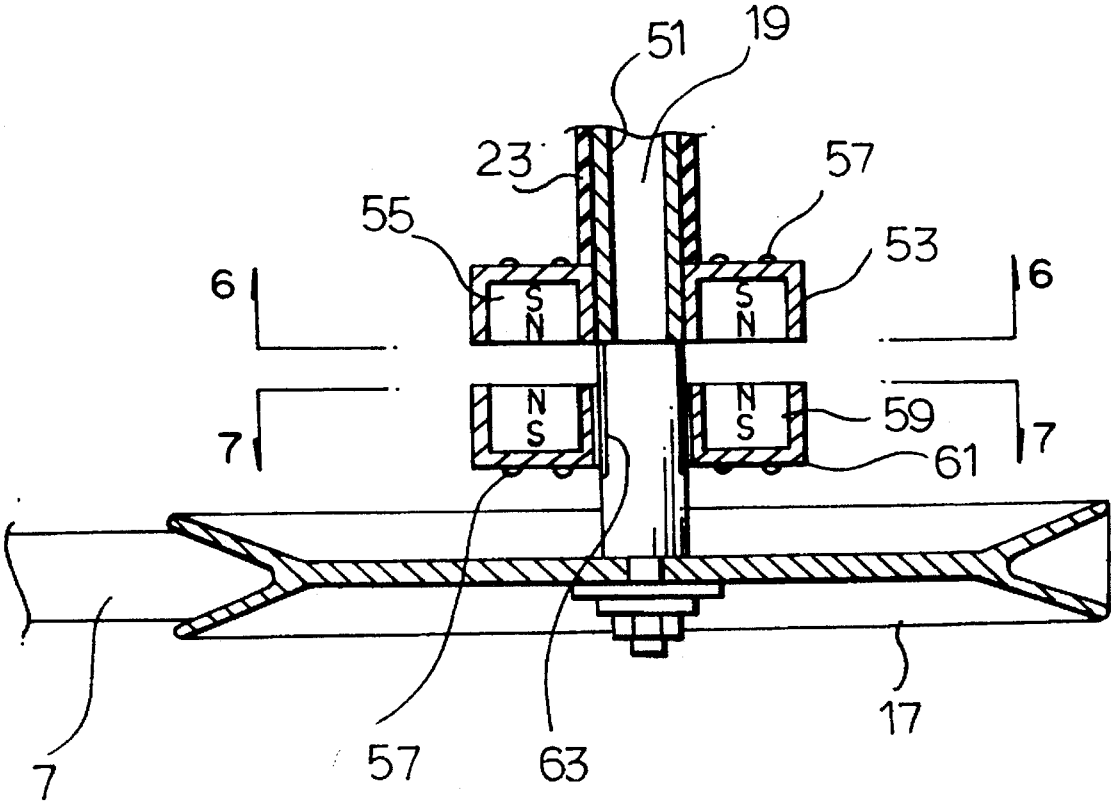
FIG. 5 is a sectional view of principal parts illustrating a pulsator disc and a spin-drying disc of FIG. 4 during a washing process.

The spin-drying tub disc 53 is formed with grooves for mounting a plurality of first electromagnets 55, (see FIG. 5).

Furthermore, under the spin-drying tub disc 53, a pulsator disc 61 carrying a plurality of second electromagnets is longitudinally slidingly keyed to the driving washing shaft 19 by splines 63, so that the power can be transmitted to or cut off from the spin-drying tub disc 53 as will be explained.

The serrations 63 are respectively formed in a through hole of the pulsator disc 61 and a periphery of the driving washing shaft 19.

At this time, wirings (not shown) are respectively connected to electric power supply means and control means in order to supply power to the first and second electromagnets 55 and 59, and to control the first and second electromagnets 55 and 59.

Next, operation and effect therefrom will be described according to the above described embodiment of the present invention thus constructed.

Figure 6:
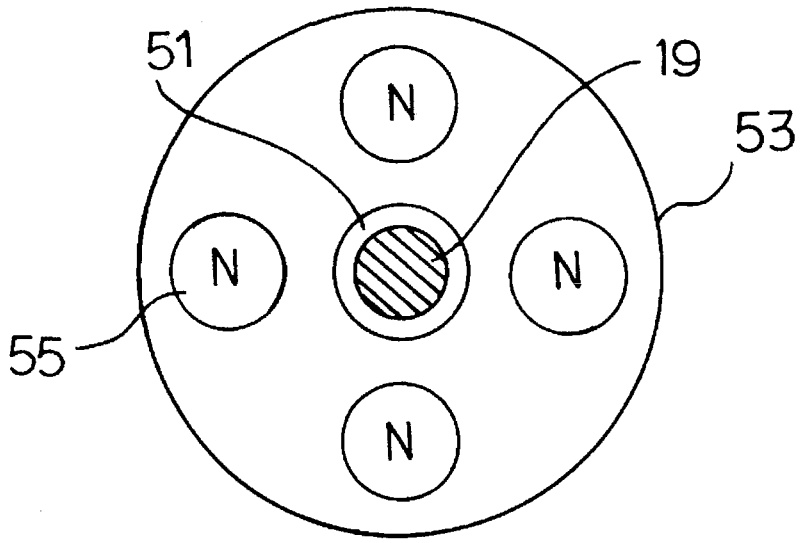
FIG. 6 is a sectional view taken along line 6—6 in FIG. 5.
Figure 7:
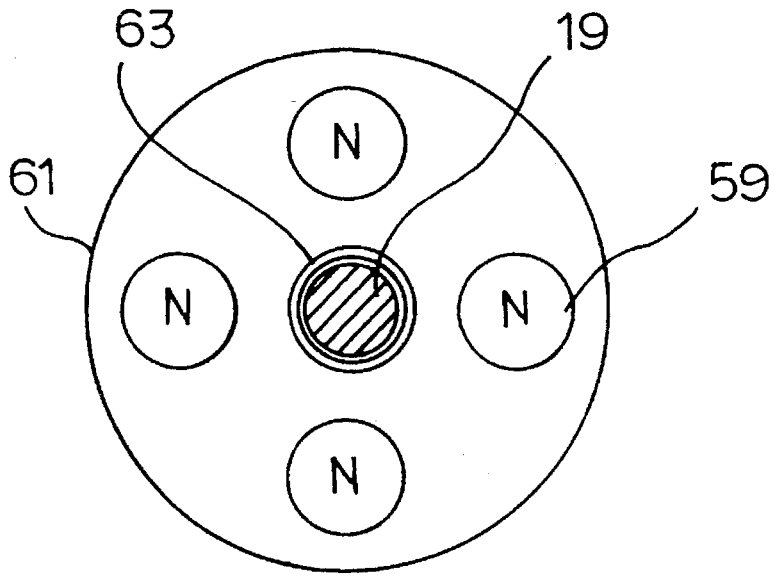
FIG. 7 is a sectional view taken along line 7—7 in FIG. 5.

During the washing process, as illustrated in FIGS. 5, 6 and 7, the electric power is supplied to the first and second electromagnets 55 and 59 via the wirings (not shown) according to operation of the control means (not shown), so that the same polarity is induced at a lower portion of the first electromagnet 55 and at an upper portion of the second electromagnet 59.

As a result, the spin-drying tub disc 53 employing the first electromagnet 55 and the pulsator disc 61 employing the second electromagnet 59 are mutually repelled, so that the pulsator disc 61 moves downward along the splines 63 of the driving washing shaft 19, and the spin-drying tub disc 53 and the pulsator disc 61 are now in a state of separation.

Accordingly, the turning effect of the motor 5 transmitted from the driving washing shaft 19 to shaft 29 is reduced in speed by a planetary gear (not shown). A pulsator 11 coupled to an upper end of the washing shaft 29 oscittates to thereby carry out the washing.

Figure 8:
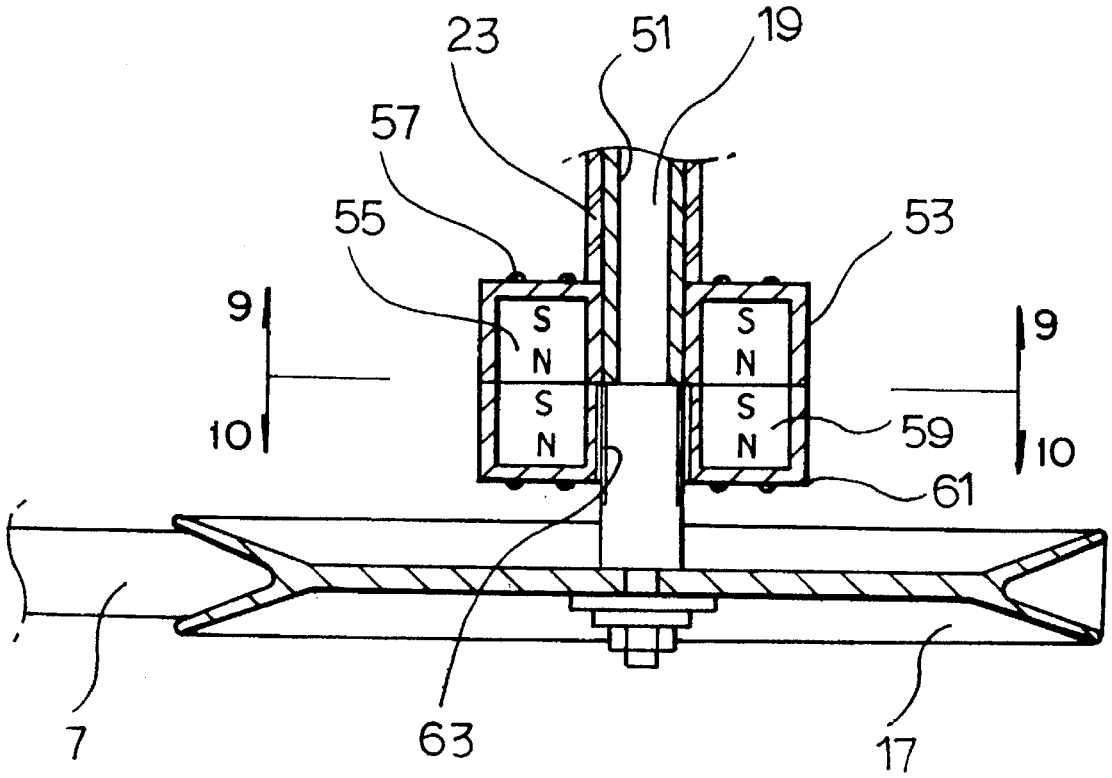
FIG. 8 is a sectional view of principal parts illustrating the pulsator disc and the spin-drying disc of FIG. 4 during a spin-drying process.
Figure 9:
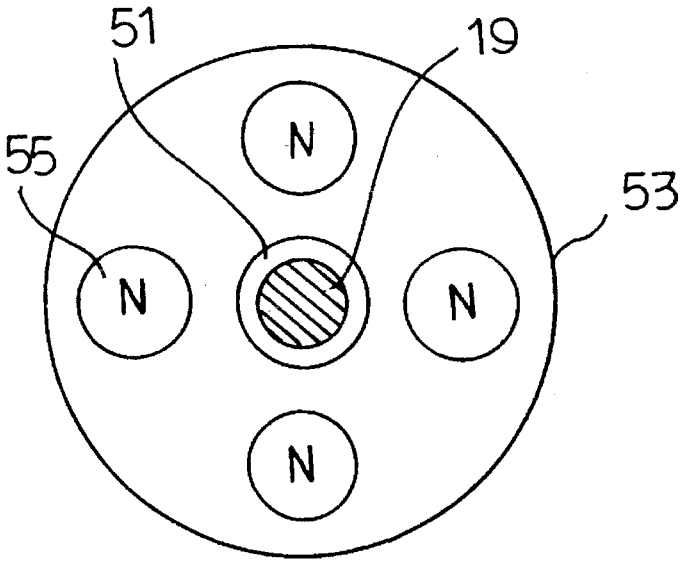
FIG. 9 is a sectional view taken along line 9—9 in FIG. 8.
Figure 10:
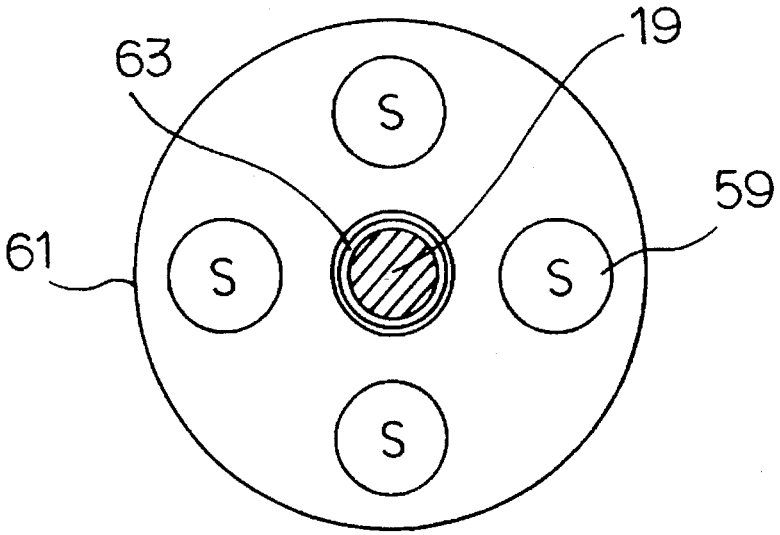
FIG. 10 is a sectional view taken along line 10—10 in FIG. 8.

However, during the spin-drying process, as illustrated in FIGS. 8, 9 and 10, the power is supplied to the first and second electromagnets 55 and 59 via wirings (not shown) according to the operation of the control means (not shown), so that a mutual different polarity is induced to the lower portion of the first electromagnet 55 and to the upper portion of the second electromagnet 59.

Accordingly, the spin-drying tub disc 53 employing the first electromagnet 55 and the pulsator disc 61 employing the second electromagnet 59 are mutually attracted, so that the pulsator disc 61 moves upward along the splines 63 of the driving washing shaft 19, whereby the spin-drying tub disc 53 and the pulsator disc 61 are now in a connected state.

Accordingly, the turning effect of the motor 5 is transmitted from the driving washing shaft 19 to the first spin-drying shaft 23, connector 25 and the second spin-drying shaft 27 in that order, and the spin-drying tub 9 connected to an upper end of the second spin-drying shaft 27 is rotated thereby to enable the washing machine to carry out the spin-drying.

Although the above description has explained one embodiment of a power transmission apparatus in a washing machine, wherein the spin-dry tub disc 53 employing the first electromagnet 55 is fixedly disposed on the first spin-drying shaft 23, and the pulsator disc 61 employing the second, electromagnet 59 is slidingly arranged on the driving washing shaft 19, it is not intended to limit the scope of this invention.

Figure 11:
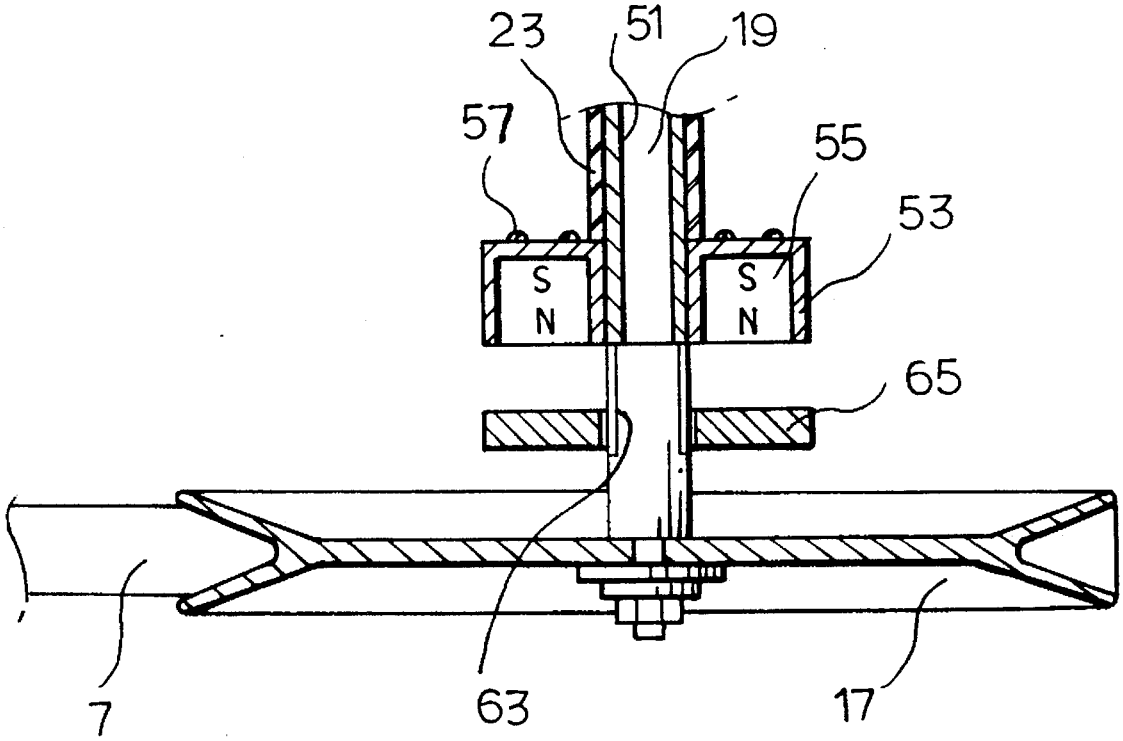
FIG. 11 is a longitudinal sectional view of a power transmission apparatus of a washing machine according to another embodiment of the present invention.

By way of example, in another embodiment illustrated in FIG. 11, it should be apparent that the spin-drying tub disc 53 employing the first electromagnet 55 could be fixedly provided on the first spin-drying shaft 23, and the driving washing shaft 19 is provided with a longitudinally slidable pulsator disc 65 in the form of a thin metallic material.

Figure 12:
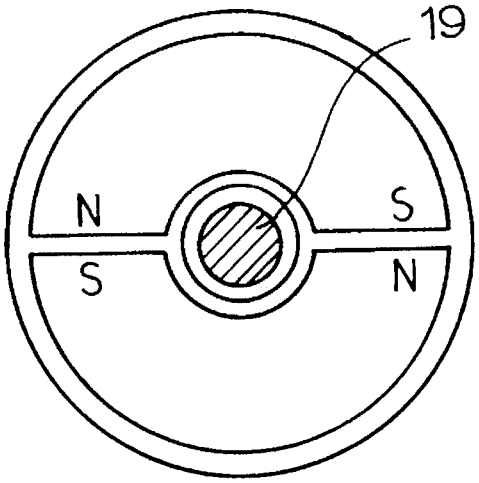
FIG. 12 is a plan view illustrating a state of an electromagnet according to a still another embodiment of the present invention.

Furthermore, in still another embodiment illustrated in FIG. 12, it should be also apparent that shape of the electromagnets can be changed without departing from the spirit and the scope of the present invention.

According to the power transmission apparatus of a washing machine described in the foregoing, a spin-drying tub disc employing a first electromagnet is fixedly mounted on a first spin-drying shaft, and a pulsator disc employing a second electromagnet is slidingly mounted on a driving washing shaft, thereby reducing a manufacturing cost thereof, and at the same time, enabling a complete transfer of the electric power during the washing and spin-drying processes.

Having described specific preferred embodiments of the invention with reference to the accompanying drawings, it is to be understood that the invention is not limited to those precise embodiments, and that various changes and modifications may be effected herein by one skilled in the art without departing from the scope or spirit of the invention as defined in the appended claims.

What is claimed is:

1. A clothes washing machine comprising:

a spin-drying tub rotatable about an axis;

a pulsator disposed in the spin-drying tub and movable relative thereto for agitating water therein;

an electric motor;

a washing shaft connected to said motor to be rotated thereby and being connected to said pulsator to drive said pulsator;

a spin-drying shaft operably connected to said spin-drying tub; and a drive-transmitting mechanism for selectively transmitting power from said washing shaft to said spin-drying shaft, comprising:

a first member connected to one of said spin-drying shaft and said washing shaft for rotation therewith; and a second member connected to the other of said spin-drying shaft and said washing shaft for rotation therewith, said second member being longitudinally slidable along said other shaft between a first position out of drive-transmitting relationship with said first member, and a second position in drive transmitting relationship with said first member;

wherein said at least one of said first and second members carries an electromagnet energizable to attract said first and second members together to said second position.

2. The clothes washing machine according to claim 1 wherein said electromagnet is of reversible polarity to repel said first and second members away from one another to said first position.

3. The clothes washing machine according to claim 1 wherein each of said first and second members carries an electromagnet magnet.

4. The clothes washing machine according to claim 1 wherein one of said first and second members carries a magnet, and the other of said first and second members includes a metallic material.

5. The clothes washing machine according to claim 4 wherein said magnet comprises an electromagnet.

6. The clothes washing machine according to claim 1 wherein said second member is mounted to said washing shaft by a splined connection.

7. The clothes washing machine according to claim 1 wherein said pulsator is oscillatable about said axis.

8. A clothes washing machine comprising:

a spin-drying tub rotatable about an axis;

a pulsator disposed in the spin-drying tub and movable relative thereto for agitating water therein;

an electric motor;

a washing shaft connected to said motor to be rotated thereby and being connected to said pulsator to drive said pulsator;

a spin-drying shaft operably connected to said spin-drying tub; and a drive-transmitting mechanism for selectively transmitting power from said washing shaft to said spin-drying shaft, comprising:

an electromagnet connected to one of said washing and spin-drying shafts for rotation therewith, and a metallic plate connected to the other of said washing and spin-drying shafts for rotation therewith, one of said electromagnet and metallic plate being slidable relative to its respective shaft between a first position in drive-transmitting relationship with the other of said electromagnet and metallic plate under the influence of a magnetic attraction, and a second position out of drive transmitting relationship with said other of said electromagnet and said metallic plate.

* * * * *